US006540816B2

(12) United States Patent
Allie et al.

(10) Patent No.: US 6,540,816 B2
(45) Date of Patent: Apr. 1, 2003

(54) REGENERABLE FILTER WITH LOCALIZED AND EFFICIENT HEATING

(75) Inventors: Mark C. Allie, Stoughton, WI (US); Barry M. Verdegan, Stoughton, WI (US); Murray R. Schukar, Fitchburg, WI (US); William C. Haberkamp, Cookeville, TN (US); C. Raymond Cheng, Madison, WI (US); Matthew P. Henrichsen, Columbus, IN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/935,849

(22) Filed: Aug. 23, 2001

(65) Prior Publication Data

US 2003/0037674 A1 Feb. 27, 2003

(51) Int. Cl.[7] ..... B01D 46/00; B01D 29/62

(52) U.S. Cl. ..... 95/278; 55/282.2; 55/282.3; 55/520; 55/521; 55/523; 55/DIG. 5; 55/DIG. 10; 55/DIG. 30; 264/171.1; 264/257; 264/258; 264/DIG. 48; 156/210

(58) Field of Search ..... 55/282.2, 282.3, 55/520, 521, 523, DIG. 5, DIG. 10, DIG. 30; 60/303, 311; 264/171.1, 257, 258, 339, DIG. 48, 116, 117, 118; 156/210; 95/278

(56) References Cited

U.S. PATENT DOCUMENTS

| | | | | | |
|---|---|---|---|---|---|
| 4,017,347 | A | | 4/1977 | Cleveland | 156/89.27 |
| 4,652,286 | A | * | 3/1987 | Kusuda et al. | 55/523 |
| 4,934,141 | A | * | 6/1990 | Ollivon et al. | 60/303 |
| 5,014,509 | A | | 5/1991 | Broering et al. | 60/274 |
| 5,052,178 | A | | 10/1991 | Clerc et al. | 60/274 |
| 5,063,736 | A | | 11/1991 | Hough et al. | 60/286 |
| 5,194,078 | A | * | 3/1993 | Yonemura et al. | 55/523 |
| 5,195,317 | A | * | 3/1993 | Nobue et al. | 55/DIG. 30 |
| 5,250,094 | A | | 10/1993 | Chung et al. | 55/523 |
| 5,258,164 | A | | 11/1993 | Bloom et al. | 422/174 |
| 5,298,046 | A | | 3/1994 | Peisert | 55/486 |
| 5,322,537 | A | * | 6/1994 | Nakamura et al. | 55/523 |
| 5,405,422 | A | * | 4/1995 | Ueda et al. | 55/282.3 |
| 5,409,669 | A | | 4/1995 | Smith et al. | 422/174 |
| 5,423,180 | A | * | 6/1995 | Nobue et al. | 60/303 |
| 5,453,116 | A | | 9/1995 | Fischer et al. | 95/278 |
| 5,457,945 | A | | 10/1995 | Adiletta et al. | 55/301 |
| 5,458,664 | A | | 10/1995 | Ishii et al. | 55/282 |
| 5,472,462 | A | | 12/1995 | Pischinger et al. | 55/282 |
| 5,497,620 | A | | 3/1996 | Stobbe | 60/303 |
| 5,571,298 | A | | 11/1996 | Buck | 55/267 |
| 5,620,490 | A | * | 4/1997 | Kawamura | 55/282.3 |
| 5,651,250 | A | * | 7/1997 | Kawamura | 55/523 |
| 5,656,048 | A | | 8/1997 | Smitih et al. | 55/282 |
| 5,846,276 | A | | 12/1998 | Nagai et al. | 55/523 |
| 5,873,918 | A | | 2/1999 | Dillman et al. | 55/282.3 |
| 6,090,172 | A | * | 7/2000 | Dementhon et al. | 55/282.3 |
| 6,090,187 | A | * | 7/2000 | Kumagai | 95/278 |
| 6,379,407 | B1 | * | 4/2002 | Blackwell et al. | 55/282.3 |
| 2001/0017026 | A1 | * | 8/2001 | Peters et al. | 55/282.3 |

* cited by examiner

*Primary Examiner*—Duane Smith
*Assistant Examiner*—Jason M. Greene
(74) *Attorney, Agent, or Firm*—Andrus, Sceales, Starke & Sawall, LLP

(57) ABSTRACT

An exhaust aftertreatment filter is provided with localized and efficient heating for regeneration. Electrical and/or thermal conductors are wound with filter media sheets into a filter roll and/or conductors are provided at axial ends of the filter roll and/or microwave radiation is used for localized hot zone heating. Regeneration is provided at lateral slices of the filter roll lying in a plane extending transversely and radially relative to the filter roll axis.

31 Claims, 7 Drawing Sheets

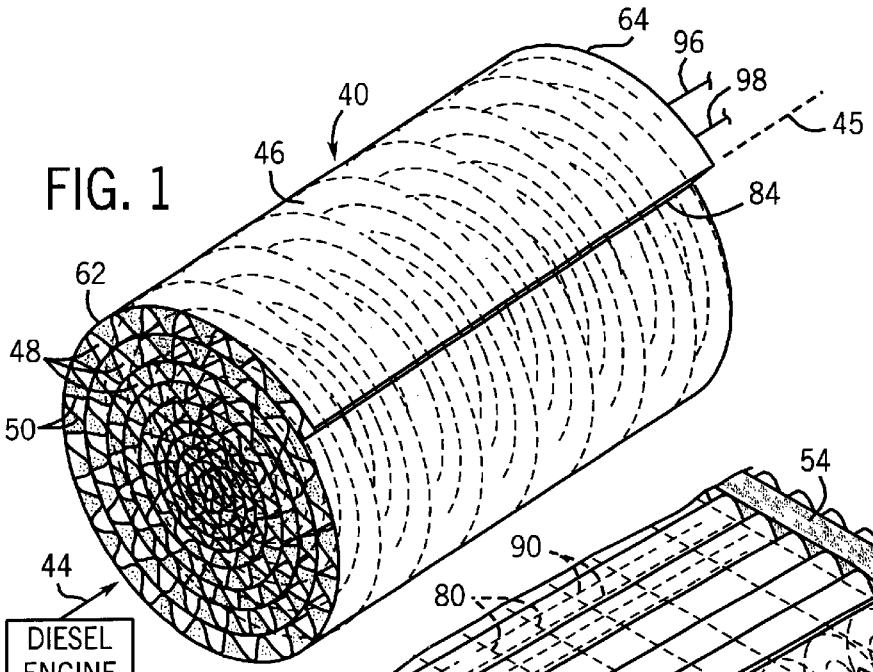
FIG. 1
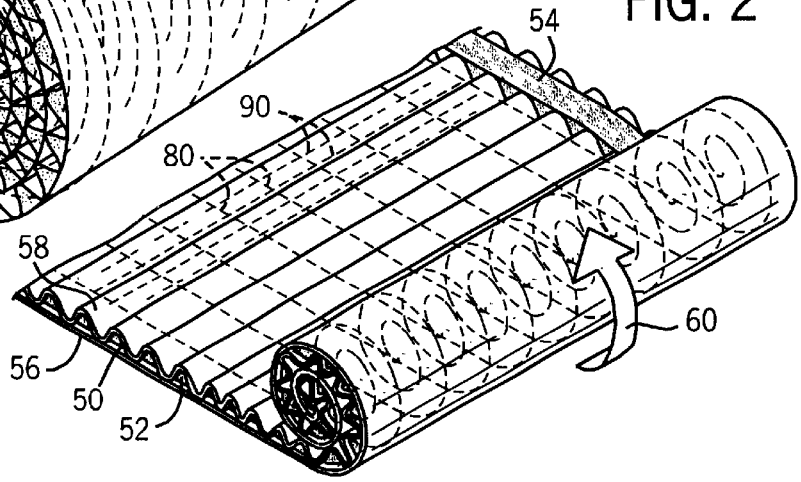
FIG. 2
FIG. 3
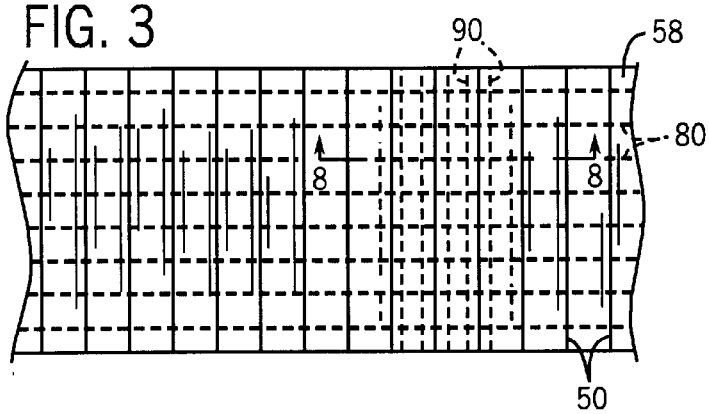
FIG. 4
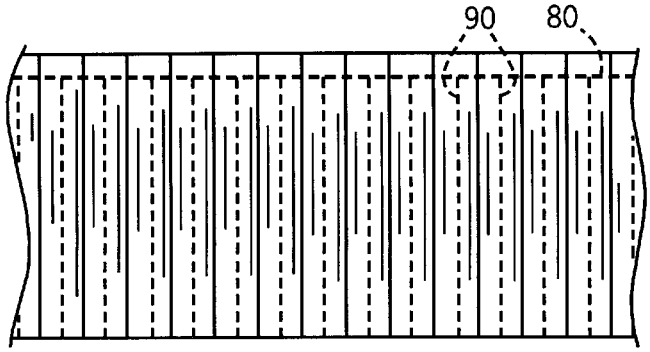

FIG. 13
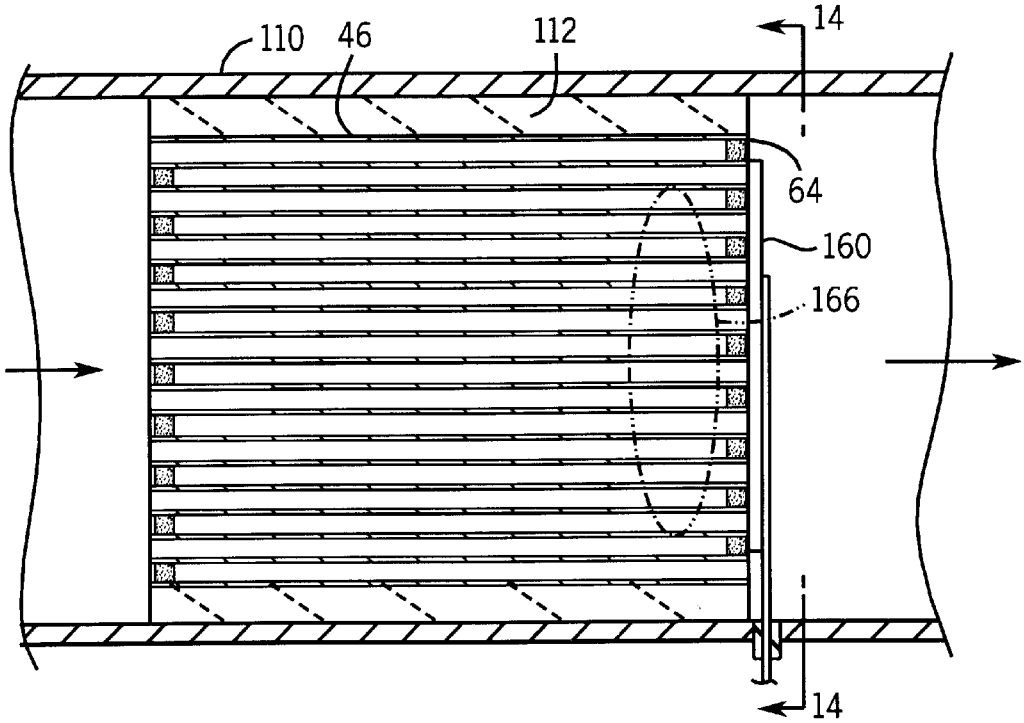
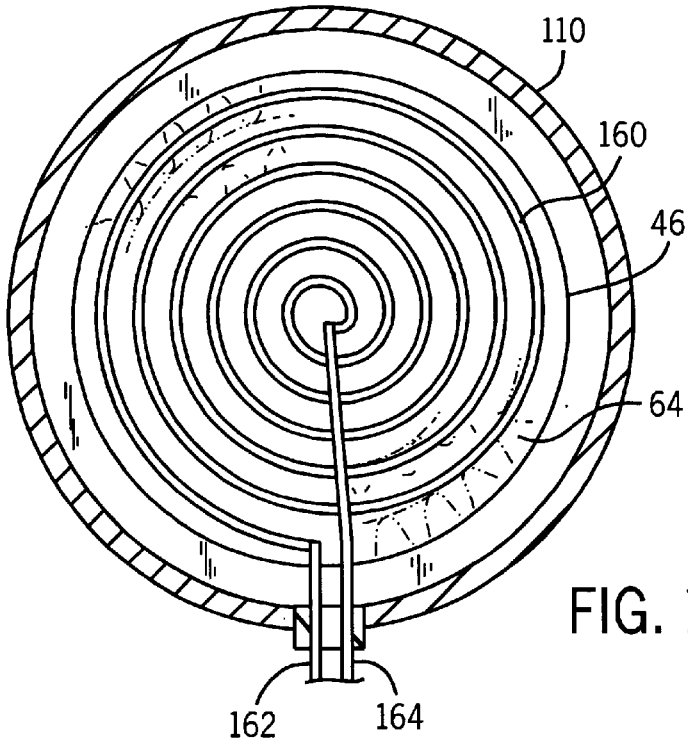
FIG. 14

FIG. 15
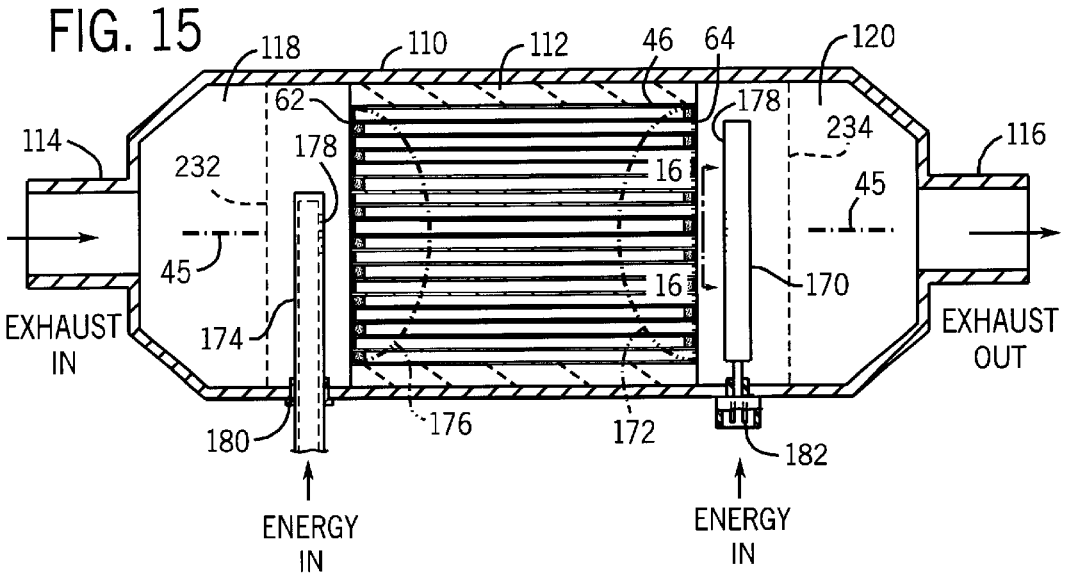
FIG. 16
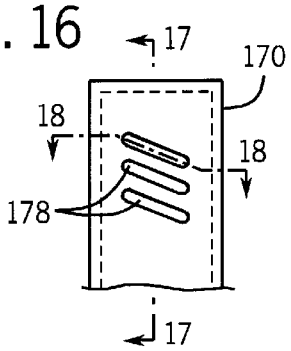
FIG. 17
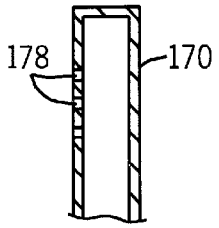
FIG. 18
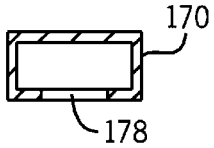
FIG. 19
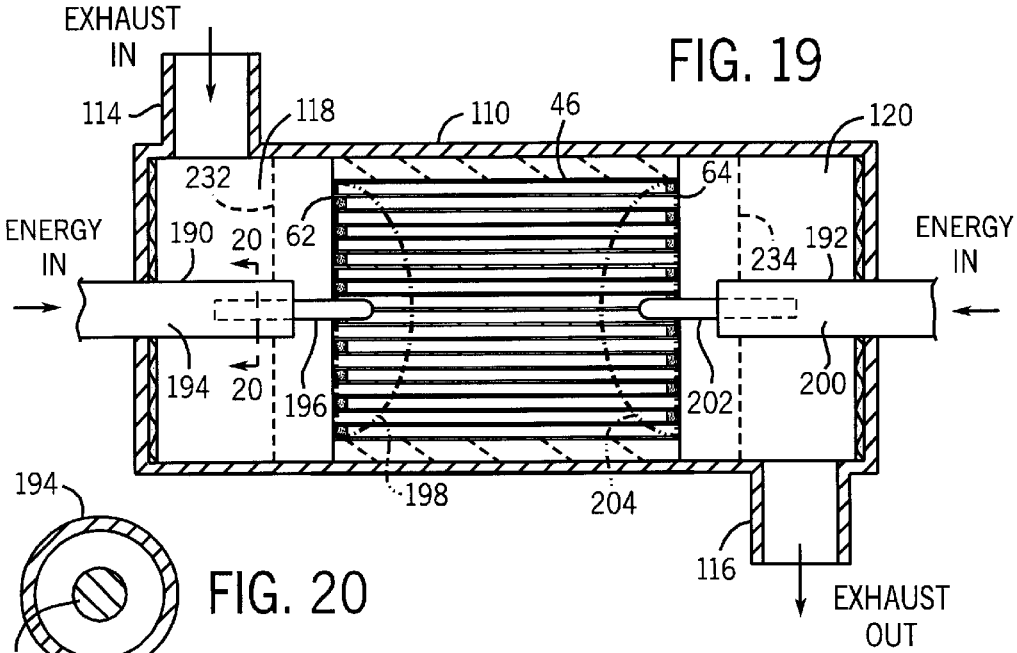
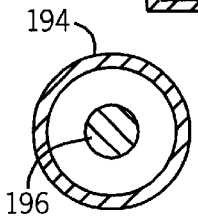
FIG. 20

FIG. 21
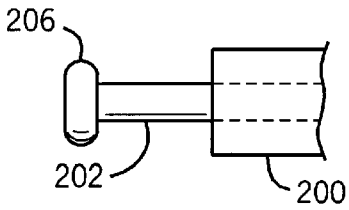
FIG. 22
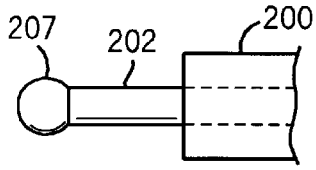
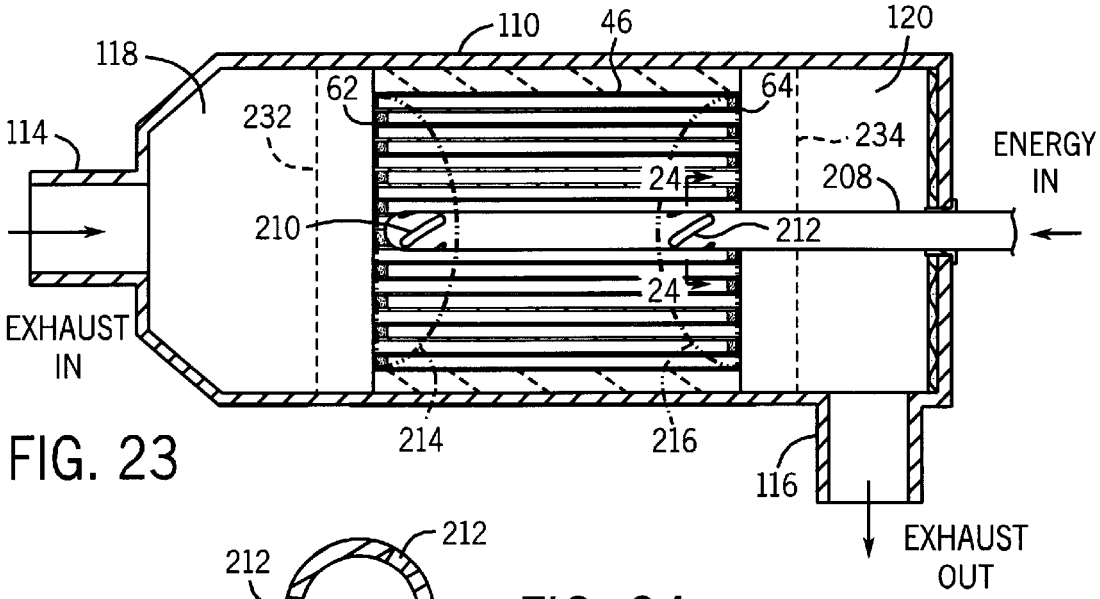
FIG. 23
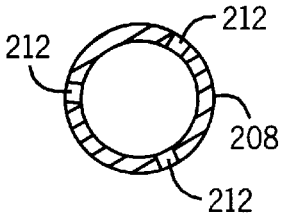
FIG. 24
FIG. 25
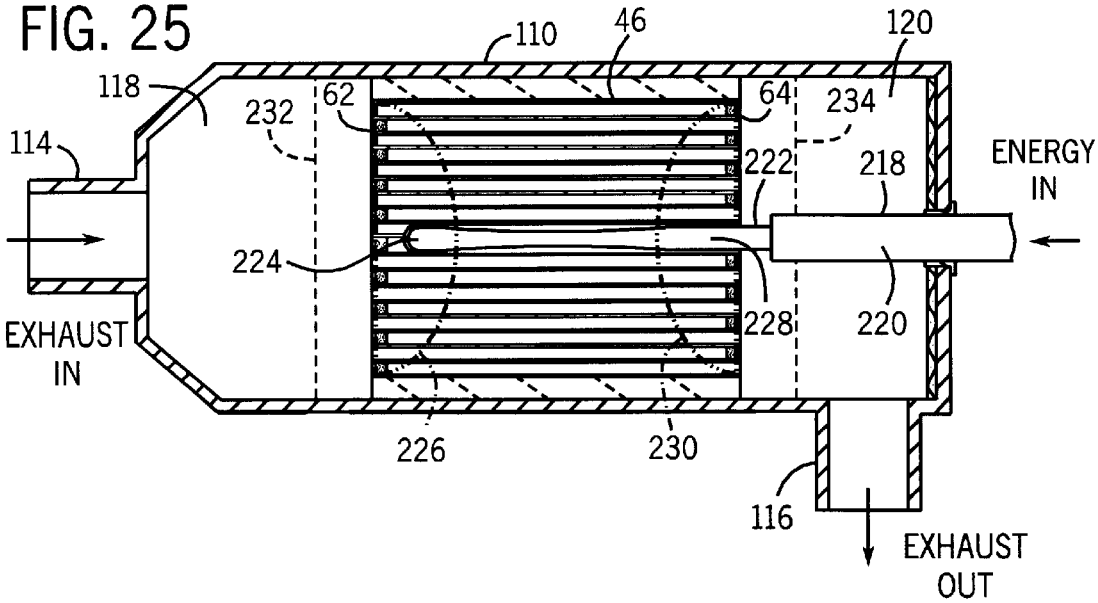

REGENERABLE FILTER WITH LOCALIZED AND EFFICIENT HEATING

BACKGROUND AND SUMMARY OF THE INVENTION

The invention relates to exhaust aftertreatment filters for filtering exhaust from internal combustion engines, including diesel engines, and more particularly to regeneration of such filters by heat to incinerate or burn-off contaminant particulate collected from the engine exhaust.

Exhaust aftertreatment filters for diesel engines are known in the prior art. The filter traps contaminant particulate in the exhaust. The filter is composed of regenerable material which is regenerated by heat to burn-off the trapped contaminant particulate. These filters can become plugged if conditions necessary for regeneration of captured particulate such as soot are not achieved. Such conditions typically occur in stop-and-go city driving conditions and extended periods of idle and/or low load. In such situations, exhaust temperatures are not hot enough to trigger incineration of captured diesel particulates in the filter. To overcome this problem, heat can be applied in a variety of ways. In the past, emphasis has been on heating the entire filter to regenerate it. This requires significant energy consumption. Furthermore, in the process, heat is not always efficiently utilized, and filter durability issues can result.

The present invention addresses and solves the above-noted problems, including energy consumption and durability issues. The entire filter is not necessarily heated, but rather localized heating at strategically chosen locations is instead recognized and used. Contaminant particulate tends to collect in the ends of the filter, particularly the downstream end. Heating elements are accordingly located at points along the axis of the filter where particulate accumulation is greatest and where heat application and regeneration have the greatest affect. An advantage of localized heating is that energy can be focused at specific points along the filter, and, if needed, regeneration can be initiated at different locations at different times, to conserve energy. There is no need for additional heating elements nor for heating the entire filter element.

In one aspect, heating is applied across radial cross-sections of the filter, and the axial location of these cross-sections is determined based on where particulates are expected to accumulate. This is significant in that there is regeneration uniformly across the cross-section of the filter, in contrast to prior methods characterized by radially distributed failure patterns due to uneven heating across the cross-section. One or more cross-sectional heating elements may be used in a particular filter element.

In another aspect, axially aligned conductors are used to facilitate flow of electrical current and/or thermal energy. When multiple cross-sectional heating elements are used, the axial conductors typically conduct both electricity and heat. In single cross-sectional heating element versions, the axial conductors may be used solely as heat conductors and not to conduct electrical current.

The geometry and method of manufacture of the filter element are significant. The filter element is spiral wound by rolling layers of flat and pleated sheets into a roll. The process and geometry allows the heating element conductors to be easily incorporated into the media and form cross-sectional heating conductor elements with uniformly spaced electrically and/or thermally conductive material. This is not possible with extruded filter elements such as cordierite monoliths. The process also allows heating elements to be interconnected by axially aligned conductors or to be individually or directly attached to a power source.

In another aspect, the conductors used as heating elements serve a dual function, namely firstly as electrical conductors, and secondly as heat conductors to conduct heat to other portions of the filter. The latter is important when conductors are aligned axially to transfer heat from the strategically heated locations to other portions of the filter.

In a further aspect, the electrical and/or thermal conductors are embedded into the filter media and/or attached to the surface of the media with a suitable binder or adhesive or are laminated in place. The conductors are oriented axially and/or laterally. The axial location of the laterally extending conductors is significant. It is preferred that the first such conductor be located as near as possible to the edge of the filter media as it is spiral wound, to provide such conductor located at the axial end of the filter roll after such winding. Other laterally extending conductors are axially spaced at intervals along the media as determined by heating needs. For electrically heated filters, these would typically be spaced at regular intervals along the entire upstream to downstream axial length of the filter roll.

In a further aspect, electrical and/or thermal conductors are additionally provided which are oriented and extend axially at laterally spaced intervals. This can further enhance thermal efficiency.

In a further aspect, two sheets of media are spiral wound to form the filter roll, one sheet being flat and the other being pleated. When sets of both axial and lateral conductors are used, it is preferred that the set of laterally extending conductors be provided on one layer, and the set of axially extending conductors be provided on the other layer.

The conductors may be in various forms, including round wire, flat ribbon, particle based bound into adhesive or a binder, and the like.

In a further aspect, the heating elements are not built into the media nor rolled therewith, but rather are attached to the end of the filter. The heater element is energized by direct connection electrical resistance heating. The heater element conducts thermal energy to the filter element.

In a further aspect, microwave energy is coupled to the filter element via a waveguide or an antenna, and the filter is heated at strategic locations for faster regeneration. Since the heating rate is proportional to the microwave power supplied, it will take a substantial amount of microwave power to provide uniform heating of the entire filter element. It is thus important to use the energy to heat the filter at the areas where it is most needed for faster regeneration. The most effective way is to create a hot zone by strategically placing the microwave emitter (e.g. antenna or slotted waveguide) where the highest concentration of soot or other contaminant particulate is located. Waveguides or antennas are placed at one or both ends of the filter, and can be internal or external to the filter element. In one aspect, slotted waveguides are placed within the filter housing externally of the filter element and near the axial ends of the filter. When slotted waveguides are used on the upstream dirty side of the filter, care must be taken to keep the soot particles from entering the microwave power system, as this will degrade or damage same. The waveguide on the downstream clean side is protected from the pollutant and is therefore at less risk. Antenna probes can conduct microwave energy to heat the regions near both ends of the filter. The antenna probe can be cylindrical or with a doorknob or ball shape, which allows for higher power levels without arcing.

In further aspects, the waveguide or antenna is located within the filter between the upstream and downstream distally opposite axial ends of the filter element. A center core is cut out in the filter, and the area is dependent on the size of the waveguide or antenna. The geometry of the waveguide or antenna is designed such that the energy distributed is at the highest near both ends of the filter. This may be accomplished by using uniformly spaced slots in the waveguide or a shaped antenna.

BRIEF DESCRIPTION OF THE DRAWINGS

FIG. 1 is an isometric assembled view of an exhaust aftertreatment filter constructed in accordance with the invention.

FIG. 2 illustrates spiral winding to provide the filter roll of FIG. 1.

FIG. 3 is a top view of a portion of the layer of FIG. 2 prior to winding.

FIG. 4 is like FIG. 3 and shows another embodiment.

FIG. 13 is like FIG. 7 and shows a further embodiment.

FIG. 14 is a sectional view taken along line 14—14 of FIG. 13.

FIG. 15 is like FIG. 7 and shows a further embodiment.

FIG. 16 is a sectional view taken along line 16—16 of FIG. 15.

FIG. 17 is a sectional view taken along line 17—17 of FIG. 16.

FIG. 18 is a sectional view taken along line 18—18 of FIG. 16.

FIG. 19 is like FIG. 7 and shows a further embodiment.

FIG. 20 is a sectional view taken along line 20—20 of FIG. 19.

FIG. 21 is an enlarged view of a portion of FIG. 19 and shows a further embodiment.

FIG. 22 is a view like FIG. 21 and shows a further embodiment.

FIG. 23 is a view like FIG. 7 and shows a further embodiment.

FIG. 24 is a sectional view taken along line 24—24 of FIG. 23.

FIG. 25 is a view like FIG. 23 and shows a further embodiment.

DETAILED DESCRIPTION OF THE INVENTION

Figure 5:
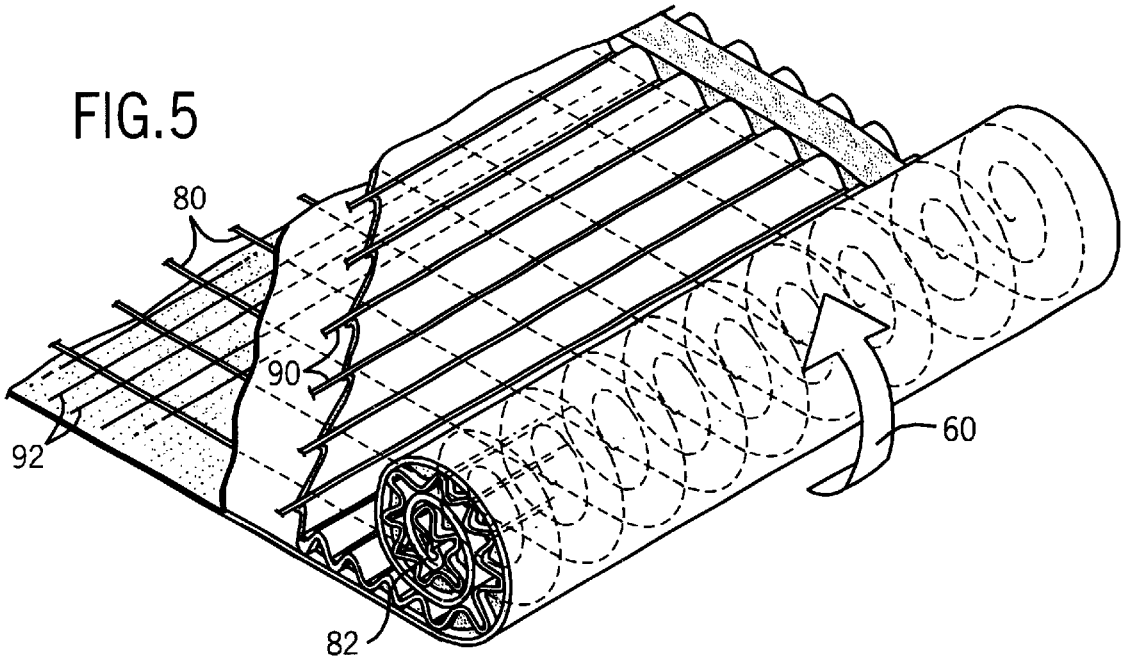
FIG. 5 is like FIG. 2 and shows a further embodiment, partially cut away.
Figure 6:
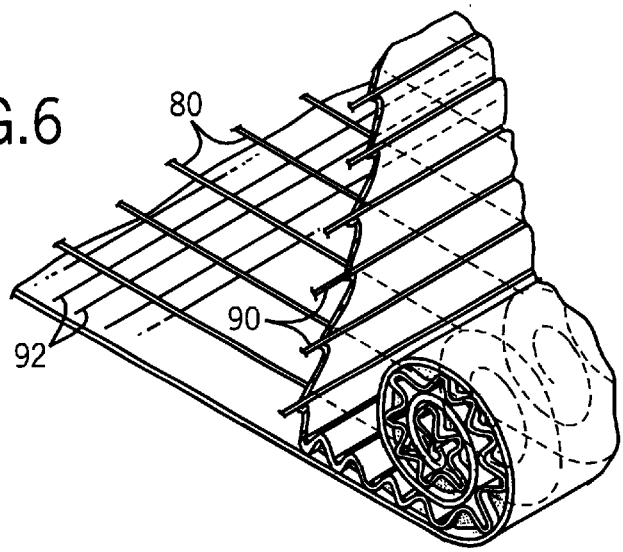
FIG. 6 is like FIG. 5 and shows a further embodiment.

FIG. 1 shows an exhaust aftertreatment filter 40 for filtering exhaust from an internal combustion engine, such as diesel engine 42, flowing along an axial direction 44. The filter is provided by an axially extending cylindrical filter roll 46 extending axially along axis 45 and having a plurality of concentric layers 48 with pleats 50 therebetween defined by wall segments extending in zig-zag manner between pleat tips at axially extending bend lines. Upstream and downstream axially spaced sealing beads 52 and 54, FIG. 2, for example adhesive strips or the like, extend transversely across the pleats, one of the beads such as 52 being below the pleats, and the other beads such as 54 being above the pleats. The filter media is provided by flat sheet 56 and pleated or corrugated sheet 58. Spiral winding of sheets 56 and 58 as shown at arrow 60 in FIG. 2 yields cylindrical filter roll 46 of FIG. 1. The pleats define axial flow channels between upstream axial end 62 and downstream axial end 64 of the filter roll. The wall segments of the flow channels are alternately sealed to each other at upstream end 62 by a first upstream set of plugs 66, FIG. 7, to define a first set of flow channels 68 closed at the upstream end by plugs 66. Plugs 66 are provided by sealing bead 52. The wall segments of the flow channels are also alternately sealed to each other at downstream end 64 by a second downstream set of plugs 70 to define a second set of flow channels 72 closed at the downstream end by plugs 70. Downstream set of plugs 70 are provided by sealing bead 54. The first set of flow channels 68 are interdigitated with the second set of flow channels 72. Flow channels 72 have open upstream ends at 62 and closed downstream ends at 64. Flow channels 68 have closed upstream ends at 62 and open downstream ends at 64. Exhaust flowing axially rightwardly at 44 in FIG. 7 thus flows into the open upstream ends of flow channels 72 and then through the wall segments of the filter media of sheets 56 and 58 and then through the open downstream ends of flow channels 68 and then exits as shown at arrow 74. The structure described thus far is known in the prior art, for example as shown in U.S. Pat. Nos. 4,652,286 and 5,322,537, incorporated herein by reference. The flow channels preferably have a triangular shape in lateral cross-section as shown at 68*a* in FIG. 8, or a trapezoidal shape as shown at 68*b* in FIG. 9.

Contaminant particulate such as soot is trapped and accumulates in the filter. Flat media sheet 56 and pleated media sheet 58 are composed of filter media regenerable by heat to burn-off contaminant particulate collected from the engine exhaust, for example ceramic material as in U.S. Pat. Nos. 4,017,347, 4,652,286, 5,322,537, and preferably of a high temperature composite ceramic material as disclosed in commonly owned copending U.S. patent application Ser. No. 09/573,747, filed May 18, 2000, all incorporated herein by reference. The filter is regenerated by heat, for example as disclosed in U.S. Pat. Nos. 5,014,509, 5,052,178, 5,063,736, incorporated herein by reference. The present invention provides localized heating at a given axial location along filter roll 46, including at downstream axial end 64 where accumulation of contaminant particulate is most acute.

A first set of one or more conductors 80, FIGS. 2–8, selected from the group consisting of electrical conductors and thermal conductors, are provided at one or more given axial locations along filter roll 46 and provide localized heating at the respective location. Conductors 80 extend laterally along the sheets, preferably perpendicularly to axis 45 and perpendicularly to the axially extending bend lines of pleats 50. Sheets 56 and 58 and conductors 80 are wound in a spiral as shown at arrow 60 to provide filter roll 46. The sheets are wound along a lateral winding direction, and conductors 80 extend parallel to such lateral winding direction. The sheets are wound from a starting side 82, FIG. 5, to a terminating side 84, FIG. 1. Conductors 80 preferably extend from starting side 82, such that the resultant spiral wound conductor includes a portion in the middle of the filter along the axial centerline thereof. Conductors 80 preferably extend all the way to terminating side 84, such that the full lateral radial cross-section is heated, to be described. At a minimum, it is preferred that at least one laterally extending conductor 80 be used and that it be at the downstream end 64 of the filter roll. Each conductor 80 extends laterally across pleats 50 and provides the noted respective localized heating location as a lateral slice of filter roll 46. Such lateral slice lies in a plane extending transversely and radially relative to axis 45 of the filter roll. Each conductor 80 is a spiral around axis 45.

Figure 8:
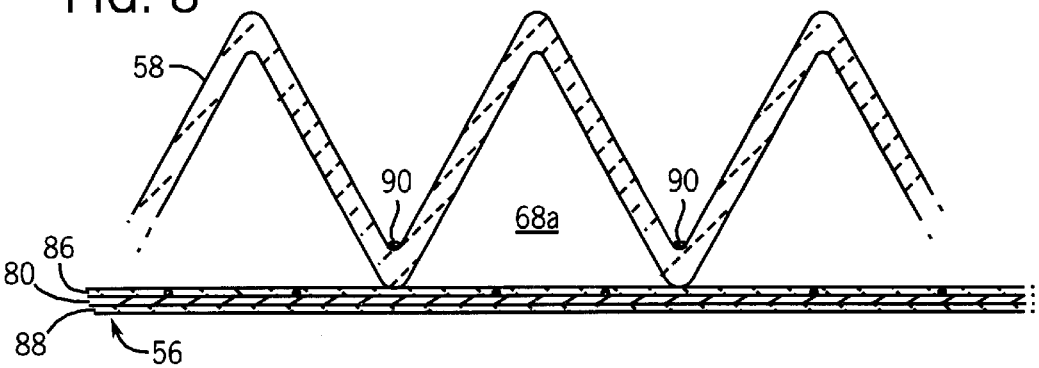
FIG. 8 is a sectional view taken along line 8—8 of FIG. 3.

In preferred form, each of conductors 80 is attached to flat sheet 56, FIG. 8, preferably by being embedded in sandwiched relation between first and second layers 86 and 88 of sheet 56. Alternatively, conductor 80 can be adhesively bonded, laminated, etc. on sheet 56, FIG. 9. Conductor 80 can be a round wire, a flat ribbon, a deposited particle strip, etc. In another embodiment, pleated sheet 58 is provided by multiple layers, and conductor 80 is embedded therein in sandwiched relation. Further alternatively, conductor 80 may be adhesively bonded, laminated or the like on sheet 58. The latter embodiments require a longer conductor 80 because it follows the sinusoid or pleat pattern of sheet 58.

A second set of one or more conductors 90, FIGS. 2–9, selected from the group consisting of electrical conductors and thermal conductors, extend axially along the sheets parallel to pleats 50. Conductors 90 are laterally spaced from each other, whereas conductors 80 are axially spaced from each other. If conductors 80 are attached to flat sheet 56, then it is preferred that conductors 90 be attached to pleated sheet 58, FIG. 8 as by bonding, lamination, embedding, or the like. Alternatively or additionally, a set of axially extending conductors 92, FIG. 9, may be provided in flat sheet 56.

Figure 9:
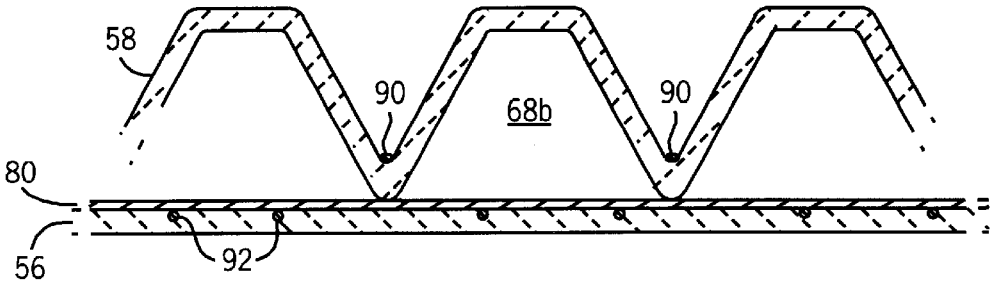
FIG. 9 is like FIG. 8 and shows a further embodiment.
Figure 10:
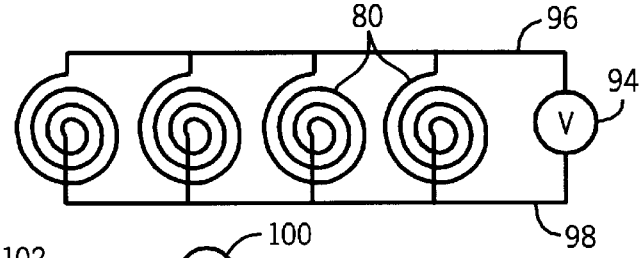
FIG. 10 is a schematic view showing circuit connection.
Figure 11:
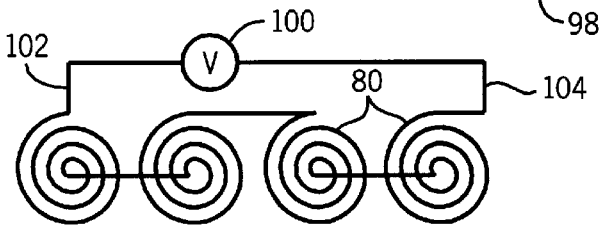
FIG. 11 is like FIG. 10 and shows another embodiment.

Many combinations are possible, though generally it is preferred that laterally extending conductors 80 be electrical conductors carrying electrical current therethrough for electrical resistance heating along the respective lateral slices axially spaced from each other, and that axially extending conductors 90 and/or 92 be thermal conductors thermally coupled to conductors 80, e.g. through sheet 58 and layer 86, FIG. 8, or by being in direct contact, FIG. 9. In one embodiment, FIG. 4, a single electrical conductor 80 is used in combination with a plurality of thermal conductors 90. Conductors 90 and/or 92 may also be electrical conductors if desired depending on circuit configuration. FIG. 10 shows a plurality of spiral wound conductors 80 connected in parallel, while FIG. 11 shows such spiral wound conductors connected in series. If it is desired that the laterally extending conductors not be electrically shorted to the axially extending conductors, then the attachment of conductors 80 and 90 on different sheets is used, as in FIG. 8. If it is desired that the laterally extending conductors be in electrical contact with the axially extending conductors, then the conductors may be on the same sheet as shown at 80 and 92 in FIG. 9, and a yet further set of conductors such as 90 may be used for further thermal conductivity, FIG. 9. The conductors and their lattice gridwork matrix can be energized in various manners, for example by applying a voltage from voltage source 94 across terminals 96 and 98, or from voltage source 100 across terminals 102 and 104, or by electromagnetic radiation, including microwave energy, to be described, or the like. Series and parallel circuits may be used, as shown, and in combination with various thermal couplings to further thermal conductors, as noted.

Figure 7:
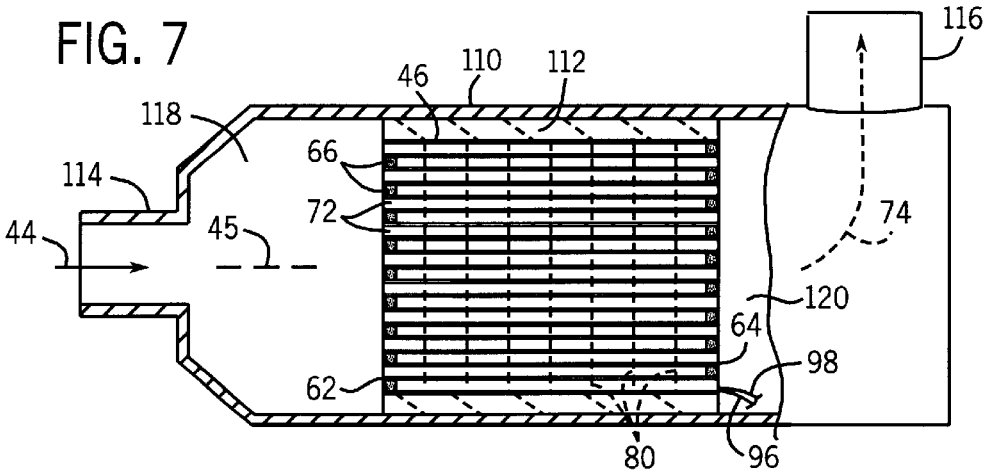
FIG. 7 is a sectional view of the filter of FIG. 1 in a housing.

Filter roll 46 is mounted in a housing 110, FIG. 7, with an annular insulating ceramic blanket 112 or the like. The housing has an inlet 114 and an outlet 116. The housing defines a first axial exhaust flow passage 118 to upstream axial end 62 of the filter roll, and a second axial exhaust flow passage 120 from downstream axial end 64 of the filter roll. Each spiral wound conductor 80 is a uni-planar member lying in a plane into and out of the page in FIG. 7, which plane extends laterally and radially relative to axis 45 and provides the noted localized heating along respective lateral slices of filter roll 46. Each conductor 80 is a spiral around axis 45.

Figure 12:
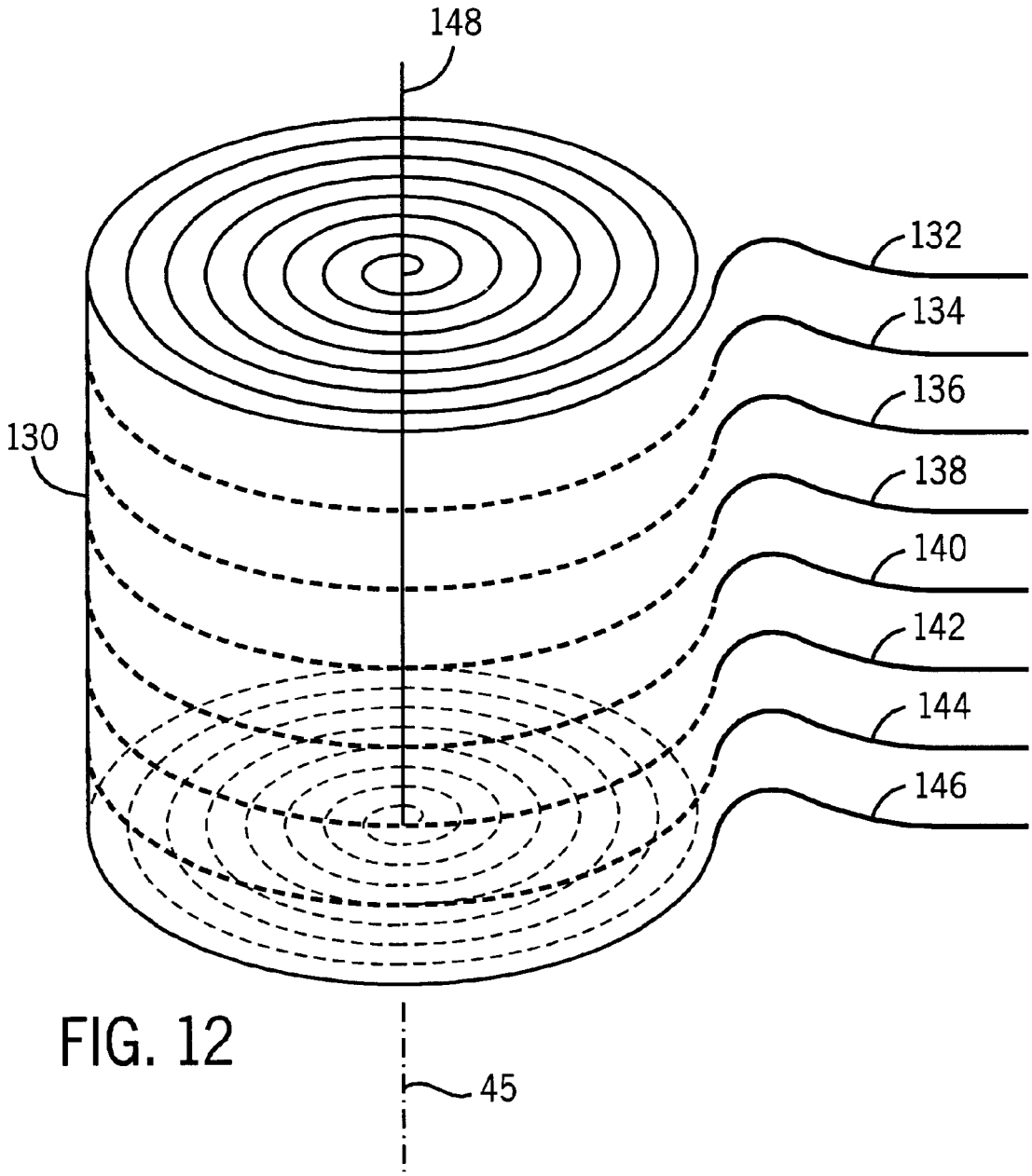
FIG. 12 is a schematic isometric view showing a further embodiment.

FIG. 12 shows a filter roll 130 and a plurality of heating elements 132, 134, 136, 138, 140, 142, 144, 146 provided by electrically and/or thermally conductive wire, foil or bound particles, incorporated into spiral wrap geometry in order to allow heat to be efficiently applied at critical locations. The conductors are rolled with the filter roll during manufacture, FIG. 2. The conductors may span along the flat sheet 56, or may span along the pleated sheet 58 and follow the pleated configuration thereof for increased conductor length and greater heating, or some combination thereof. An axially extending conductor 148, preferably at the center of the filter roll along axis 45, FIGS. 1, 12, is connected to each of the spiral wound conductors 132–146, and forms a common return path for current from any of the conductors. For example, conductor 148 is connected to ground, and any or all or any combination of conductors 132–146 are connected to a voltage source such as 94 or 100. Alternatively, conductor 148 could be connected to the voltage source, and any combination of conductors 132–146 may be grounded. The conductors generate heat using electrical excitation.

Conductors 132–146 can be electrically energized one at a time or in parallel by any suitable switching method, for example pulse width modulation, from a voltage source. Conductors 132–146 may be connected in parallel. The ability to connect different conductors 132–146 to a voltage source allows heating of different sections of the cylindrical filter roll 130. When none of the conductors 132–146 are in parallel, the regeneration of the entire filter can be done in eight steps of time, using ⅛ of the energy per step required to regenerate the entire filter all at once. The amount of energy consumed would be the same because it would take eight times longer at ⅛ the energy to regenerate the whole filter. The time steps can number from 1 to 8 by using various combinations in parallel electrical connection. If no sections were heated more than once, it would still use the same energy as heating the filter all at once. If the entire filter does not require regeneration, then less energy would be consumed by only energizing the electrical conductors in the physical regions that need regeneration. If some sections require additional heating, then they can be energized for two or more time steps in succession. This is a partial filter regeneration scheme with no moving parts.

In a further embodiment, one of conductors 132–146 is connected to ground, and any of the other conductors is connected to a voltage source such as 94 or 100, and the remaining conductors are left unconnected, i.e. open circuited. The choice of connected conductors is determined according to desired localized heating. For example, connecting conductors 132 and 134 is more desirable than connecting conductors 132 and 146, i.e. connecting conductor 132 to ground and conductor 134 to a voltage source, or vice versa, provides localized heating at the end of filter roll 130 along each of the radial slices of each respective spiral wound conductor 132 and 134. Another desirable connection may be conductors 134 and 136.

Various combinations involving two or more connections at one time are also possible. Care must be taken because the center conductor 148 will be at approximately half the voltage of the voltage source for each pair of connections. A deviation from one pair to another will cause a current to flow from one point on conductor 148 to another. Care must also be taken to make sure than most of the current only flows from one connection to another, and not from one to two or more others. For example, connecting conductors 132 and 134 to a voltage source, and conductor 136 to ground, could be problematic because twice the normal current would flow through conductor 136.

A further alternative is to eliminate conductive path 148 and permanently short conductor 132 to conductor 134, and conductor 136 to conductor 138, and conductor 140 to conductor 142, and conductor 144 to conductor 146, at the center of the filter. This results in fewer configurations for energization and allows some of the conductor ends, e.g. conductors 134, 138, 142, 146, to be permanently attached to ground. In this case, the remaining conductor ends 132, 136, 140, 144 would be connected to the voltage source for heating, one at a time or in combination.

The present method selectively energizes and conducts electrical current through one or more of the spiral wound conductors 80, 132–146 to provide localized heating along one or more respective lateral slices of filter roll 46. In the embodiment including central common conductor 148, electrical current is conducted through at least one of the spiral wound conductors and through common conductor 148. In a further embodiment, electrical current is conducted through the plurality of spiral wound conductors concurrently and in parallel and through common conductor 148. In a further embodiment, electrical current is conducted sequentially through the spiral wound conductors and through the common conductor, namely by conducting electrical current through a first of the spiral wound conductors 132 and through common conductor 148, and then conducting electrical current through a second of the spiral wound conductors 134 and through common conductor 148, and so on. In a further embodiment, the intervals for applying electrical current to the spiral wound conductors are differentially varied to provide a longer time for electrical current flow through a spiral wound conductor at a hot zone at a designated axial location along the filter roll. In a further embodiment, the spiral wound conductors are sequentially energized in respective time slots, and more than one time slot is assigned to a spiral wound conductor at a hot zone at a given axial location along the filter roll. In a further embodiment, electrical current is conducted through the spiral wound conductors by pulse width modulation. In a further embodiment, common conductor 148 is omitted or left unused, i.e. open-circuited, and electrical current is conducted through a first of the spiral wound conductors such as 132 and then through a second of the spiral wound conductors such as 134 in series, the first and second spiral wound conductors 132 and 134 being axially adjacent. In a further embodiment, again omitting common conductor 148 or leaving such conductor unused, a first and a second of the spiral wound conductors 132 and 134 are shorted to each other in series to provide a first conductor pair 132–134, a third and a fourth of the spiral wound conductors 136 and 138 are shorted to each other in series to provide a second conductor pair 136–138, and so on, to provide a plurality of conductor pairs, and providing regeneration by selectively energizing and conducting electrical current through the plurality of conductor pairs. In one form of the latter embodiment, electrical current is conducted concurrently and in parallel through the noted conductor pairs. In another form of the latter embodiment, electrical current is conducted sequentially through the noted conductor pairs.

FIGS. 13 and 14 show a further embodiment and use like reference numerals from above where appropriate to facilitate understanding. Conductor 160 is a spiral bonded by adhesive or the like to downstream axial end 64 of filter roll 46 and has terminals 162 and 164 for connection to voltage source 94 for providing electrical resistance heating. Conductor 160 is a uni-planar member lying in a plane extending laterally and radially relative to axis 45 of the filter roll, and provides localized heating along a lateral slice of the filter roll at axial end 64 thereof, to provide localized heating to burn-off and incinerate soot and collected contaminant at downstream hot spot or zone 166, in addition to or in place of localized heating provided by one or more conductors 80 or one or more conductors 132–146 providing localized heating at their respective hot spots or zones.

FIGS. 15–18 show a further embodiment and use like reference numerals from above where appropriate to facilitate understanding. A microwave source 170 extends laterally into housing 110 into axial exhaust flow passage 120, transversely to axis 45, and is spaced axially downstream from downstream axial end 64 of filter roll 46. Microwave source 170 provides localized heating at hot spot or zone 172 at an axial location at the downstream end 64 of the filter roll. A second microwave source 174 is mounted to the housing and extends laterally into the housing into axial exhaust flow passage 118, transversely to axis 45, and is spaced axially upstream from upstream axial end 62 of filter roll 46. Microwave source 174 provides localized heating at hot spot or zone 176 at an axial location at the upstream axial end 62 of the filter roll. Each microwave source is provided by a microwave waveguide having slots such as 178, FIGS. 16–18, in the interior of housing 110 and emitting and coupling microwave energy to the respective hot zone axial location. One or both of the microwave sources is preferably mounted to housing 110 at a sealing grommet, for example as shown at sealing grommet 180 for microwave source 174, such that microwave source 174 is insertable into axial exhaust flow passage 118 during regeneration, and removable therefrom during normal exhaust filtering operation. Alternatively, one or both of the microwave sources may be permanently mounted to filter housing 110, for example as shown at microwave source 170, and energized at plug-in receptacle module 182.

FIGS. 19 and 20 show a further embodiment and use like reference numerals from above where appropriate to facilitate understanding. First and second microwave sources 190 and 192 extend axially into the housing into respective first and second axial exhaust flow passages 118 and 120. Microwave sources 190 and 192 further extend axially into filter roll 46 through respective upstream and downstream ends 62 and 64. Microwave source 190 includes a waveguide 194 and an antenna 196 for emitting and radiating microwave energy to provide localized heating at hot zone 198. Microwave source 192 includes waveguide 200 and antenna 202 for emitting and radiating microwave energy for localized heating at hot zone 204. In a further embodiment, FIG. 21, one or both of the antennas may have a doorknob shaped end 206, or a ball shaped end 207, FIG. 22, to allow higher power levels without arcing.

FIGS. 23 and 24 show a further embodiment and use like reference numerals from above where appropriate to facilitate understanding. Microwave source 208 extends axially into the housing into axial exhaust flow passage 120 and axially through downstream axial end 64 of filter roll 46 and then axially within the filter roll. Microwave source 208 is provided by a waveguide having first and second sets of slots 210 and 212 providing microwave radiation emitters proximate respective upstream and downstream axial ends 62 and 64 of the filter roll and providing localized heating at hot zone 214 at a first axial location along a first lateral slice of filter roll 46 at upstream axial end 62, and localized heating at hot zone 216 at a second axial location along a second lateral slice at downstream axial end 64 of the filter roll axially spaced from the noted first lateral slice.

FIG. 25 shows a further embodiment and uses like reference numerals from above where appropriate to facilitate understanding. Microwave source 218 extends axially into housing 110 into axial exhaust flow passage 120 at waveguide 220 and further includes axially extending antenna 222 extending axially through axial downstream end 64 of filter roll 46 and then axially within the filter roll and providing a shaped antenna with an upstream lobe 224 providing localized heating at hot zone 226 at a first axial location along a first lateral slice of filter roll 46 at upstream axial end 62, and a downstream lobe 228 providing localized heating at hot zone 230 at a second axial location along a second lateral slice at downstream axial end 64 of filter roll 46 axially spaced from the noted first lateral slice.

Upstream and downstream microwave shields 232 and 234, respectively, FIGS. 15, 19, 23, 25, are provided in housing 110 between a respective microwave source emitter and the respective housing inlet 114 and housing outlet 116, and shield the respective inlet and outlet from microwaves from the respective emitter to prevent leakage of microwaves through the respective inlet and outlet. Each of shields 232 and 234 is a perforated metal plate or a screen extending laterally across the cross-sectional area of the housing, with the perforation openings or screen pore size dependent on the frequency of the microwaves. The shape and size of the noted respective hot zones in the filter roll can be tailored as desired, for example, according to geometry, microwave power, and the like.

It is recognized that various equivalents, alternatives and modifications are possible within the scope of the appended claims. For example, spiral wound, annular, concentric, and so on, include shapes such as cylindrical, oval, racetrack shaped, and the like.

What is claimed is:

1. An exhaust aftertreatment filter for filtering engine exhaust flowing along an axial direction, said filter being composed of filter media regenerable by heat to burn-off contaminant particulate collected from said engine exhaust, comprising a filter roll extending axially along an axis and having a plurality of concentric layers with pleats therebetween defined by wall segments extending in zig-zag manner between pleat tips at axially extending bend lines, a conductor, selected from the group consisting of electrical conductors and thermal conductors, at a given axial location along said filter roll and providing localized heating at said location, wherein said filter media comprises a first sheet and a second sheet, said second sheet having a plurality of said pleats, said conductor extending laterally along one of said sheets, wherein said sheets and said conductor are wound in a spiral to provide said filter roll, said sheets are wound from a starting side to a terminating side, and wherein said conductor extends from said starting side, and said conductor extends to said terminating side.

2. An exhaust aftertreatment filter for filtering engine exhaust flowing along an axial direction, said filter being composed of filter media regenerable by heat to burn-off contaminant particulate collected from said engine exhaust, comprising a filter roll extending axially along an axis and having a plurality of concentric layers with pleats therebetween defined by wall segments extending in zig-zag manner between pleat tips at axially extending bend lines, a conductor, selected from the group consisting of electrical conductors and thermal conductors, at a given axial location along said filter roll and providing localized heating at said location, and comprising a plurality of said conductors axially spaced along said filter roll at respective given axial locations, wherein said conductors extend laterally across said pleats and provide a plurality of said localized heating locations as lateral slices of said filter roll, each of said conductors is a spiral around said axis, and comprising an axially extending conductor connected to each of said spiral conductors.

3. The exhaust aftertreatment filter according to claim 2 wherein said axially extending conductor is in the center of said filter roll along said axis.

4. An exhaust aftertreatment filter for filtering engine exhaust flowing along an axial direction, said filter being composed of filter media regenerable by heat to burn-off contaminant particulate collected from said engine exhaust, comprising a filter roll extending axially along an axis and having a plurality of concentric layers with pleats therebetween defined by wall segments extending in zig-zag manner between pleat tips at axially extending bend lines, a conductor, selected from the group consisting of electrical conductors and thermal conductors, at a given axial location along said filter roll and providing localized heating at said location, wherein said filter media comprises a first sheet and a second sheet, said second sheet having a plurality of said pleats, said conductor extending laterally along one of said sheets, wherein said sheets and said conductor are wound in a spiral to provide said filter roll, and comprising a second conductor extending axially along the other of said sheets.

5. The exhaust aftertreatment filter according to claim 4 wherein said first mentioned conductor is attached to said one sheet, and said second conductor is attached to said other sheet, such that said conductors are attached to different sheets.

6. The exhaust aftertreatment filter according to claim 4 wherein said one sheet is said second sheet, and said other sheet is said first sheet.

7. An exhaust aftertreatment filter for filtering engine exhaust flowing along an axial direction, said filter being composed of filter media regenerable by heat to burn-off contaminant particulate collected from said engine exhaust, comprising a filter roll extending axially along an axis and having a plurality of concentric layers with pleats therebetween defined by wall segments extending in zig-zag manner between pleat tips at axially extending bend lines, a microwave source providing localized heating at a given axial location along said filter roll, wherein said filter roll extends axially between upstream and downstream distally opposite axial ends and is mounted in a housing defining a first axial exhaust flow passage to said upstream axial end, and a second axial exhaust flow passage from said downstream axial end, and wherein said microwave source is mounted to said housing and extends into one of said first and second axial exhaust flow passages, said microwave source extends axially into said housing, and said microwave source extends axially into said filter roll through one of said axial ends.

8. The exhaust aftertreatment filter according to claim 7 comprising a second microwave source mounted to said housing, wherein said first mentioned microwave source extends axially in said first axial exhaust flow passage and axially through said upstream axial end of said filter roll, and said second microwave source extends axially in said second axial exhaust flow passage and axially through said downstream axial end of said filter roll.

9. An exhaust aftertreatment filter for filtering engine exhaust flowing along an axial direction, said filter being composed of filter media regenerable by heat to burn-off contaminant particulate collected from said engine exhaust, comprising a filter roll extending axially along an axis and having a plurality of concentric layers with pleats therebetween defined by wall segments extending in zig-zag manner between pleat tips at axially extending bend lines, a microwave source providing localized heating at a given axial location along said filter roll, wherein said filter roll extends axially between upstream and downstream distally opposite axial ends and is mounted in a housing defining a first axial exhaust flow passage to said upstream axial end, and a second axial exhaust flow passage from said downstream axial end, and wherein said microwave source is mounted to said housing and extends into one of said first and second axial exhaust flow passages, and said microwave source extends axially through one of said upstream and downstream axial ends of said filter roll and extends axially within said filter roll, said microwave source having first and second emitters, said first emitter being proximate said one axial end of said filter roll and providing localized heating at a first axial location thereat along a first lateral slice of said filter roll, said second emitter being axially spaced from said first emitter and providing localized heating at a second axial location along a second lateral slice of said filter roll axially spaced from said first lateral slice.

10. The exhaust aftertreatment filter according to claim 9 wherein said second axial location is at the other of said axial ends of said filter roll.

11. A method for making an exhaust aftertreatment filter for filtering engine exhaust flowing along an axial direction, said filter being composed of filter media regenerable by heat to burn-off contaminant particulate collected from said engine exhaust, said filter comprising a filter roll extending axially along an axis and having a plurality of concentric layers with pleats therebetween defined by wall segments extending in zig-zag manner between pleat tips at axially extending bend lines, said method comprising providing first and second sheets, said second sheet having a plurality of said pleats, providing a conductor selected from the group consisting of electrical conductors and thermal conductors, extending said conductor laterally along one of said sheets, and winding said sheets and said conductor in a spiral to provide said filter roll, and winding said sheets from a starting side to a terminating side, and extending said conductor from said starting side, and extending said conductor to said terminating side.

12. A method for making an exhaust aftertreatment filter for filtering engine exhaust flowing along an axial direction, said filter being composed of filter media regenerable by heat to burn-off contaminant particulate collected from said engine exhaust, said filter comprising a filter roll extending axially along an axis and having a plurality of concentric layers with pleats therebetween defined by wall segments extending in zig-zag manner between pleat tips at axially extending bend lines, said method comprising providing first and second sheets, said second sheet having a plurality of said pleats, providing a conductor selected from the group consisting of electrical conductors and thermal conductors, extending said conductor laterally along one of said sheets, and winding said sheets and said conductor in a spiral to provide said filter roll, providing a plurality of said conductors axially spaced along said filter roll at respective given axial locations by providing a plurality of conductors extending laterally along one of said sheets, and winding said sheets and said conductors in a spiral to provide said filter roll, and providing an axially extending conductor along said filter roll connected to said spiral wound conductors.

13. A method for making an exhaust aftertreatment filter for filtering engine exhaust flowing along an axial direction, said filter being composed of filter media regenerable by heat to burn-off contaminant particulate collected from said engine exhaust, said filter comprising a filter roll extending axially along an axis and having a plurality of concentric layers with pleats therebetween defined by wall segments extending in zig-zag manner between pleat tips at axially extending bend lines, said method comprising providing first and second sheets, said second sheet having a plurality of said pleats, providing a conductor selected from the group consisting of electrical conductors and thermal conductors, extending said conductor laterally along one of said sheets, and winding said sheets and said conductor in a spiral to provide said filter roll, and comprising:

providing a first set of a plurality of said conductors, axially spacing said conductors of said first set at respective given axial locations along said sheets, and extending said conductors of said first set laterally along said sheets;

providing a second set of a plurality of conductors, selected from the group consisting of electrical conductors and thermal conductors, laterally spacing said conductors of said second set along said sheets, and extending said conductors of said second set axially along said pleats; and winding said sheets and said first and second sets of conductors in a spiral to provide said filter roll.

14. A method for making an exhaust aftertreatment filter for filtering engine exhaust flowing along an axial direction, said filter being composed of filter media regenerable by heat to burn-off contaminant particulate collected from said engine exhaust, said filter comprising a filter roll extending axially along an axis and having a plurality of concentric layers with pleats therebetween defined by wall segments extending in zig-zag manner between pleat tips at axially extending bend lines, said method comprising providing first and second sheets, said second sheet having a plurality of said pleats, providing a conductor selected from the group consisting of electrical conductors and thermal conductors, extending said conductor laterally along one of said sheets, and winding said sheets and said conductor in a spiral to provide said filter roll, and providing said localized heating by electrical resistance heating of said conductor.

15. A method for making an exhaust aftertreatment filter for filtering engine exhaust flowing along an axial direction, said filter being composed of filter media regenerable by heat to burn-off contaminant particulate collected from said engine exhaust, said filter comprising a filter roll extending axially along an axis and having a plurality of concentric layers with pleats therebetween defined by wall segments extending in zig-zag manner between pleat tips at axially extending bend lines, said method comprising providing first and second sheets, said second sheet having a plurality of said pleats, providing a conductor selected from the group consisting of electrical conductors and thermal conductors, extending said conductor laterally along one of said sheets, and winding said sheets and said conductor in a spiral to provide said filter roll, and providing said localized heating by thermal conduction heating of said conductor.

16. A method for regenerating an exhaust aftertreatment filter for filtering engine exhaust flowing along an axial direction, said filter being composed of filter media regenerable by heat to burn-off contaminant particulate collected from said engine exhaust, said filter comprising a filter roll extending axially along an axis and having a plurality of concentric layers with pleats therebetween defined by wall segments extending in zig-zag manner between pleat tips at axially extending bend lines, said filter having at least one conductor spirally wound therewith, said method comprising selectively energizing and conducting electrical current through said spiral wound conductor to provide localized heating along a lateral slice of said filter roll.

17. The method according to claim 16 wherein said filter has a plurality of axially spaced conductors spirally wound therewith, and comprising selectively conducting electrical current through one or more of said spiral wound conductors to provide localized heating along one or more lateral slices of said filter roll.

18. The method according to claim 17 comprising providing a common conductor connected to said spiral wound conductors, and conducting electrical current through at least one of said spiral wound conductors and through said common conductor.

19. The method according to claim 18 comprising conducting electrical current through a plurality of said spiral wound conductors concurrently and in parallel and through said common conductor.

20. The method according to claim 18 comprising conducting electrical current sequentially through said spiral wound conductors and through said common conductor, namely by conducting electrical current through a first of said spiral wound conductors and through said common conductor, and then conducting electrical current through a second of said spiral wound conductors and through said common conductor, and so on.

21. The method according to claim 20 comprising differentially varying intervals for applying electrical current to said spiral wound conductors to provide a longer time for electrical current flow through a spiral wound conductor at a hot zone at a designated axial location along said filter roll.

22. The method according to claim 20 comprising sequentially energizing said spiral wound conductors in respective time slots, and assigning more than one time slot to a spiral wound conductor at a hot zone at a given axial location along said filter roll.

23. The method according to claim 20 comprising conducting electrical current through said spiral wound conductors by pulse width modulation.

24. The method according to claim 18 comprising providing said common conductor extending axially along said filter roll.

25. The method according to claim 24 comprising providing said axially extending common conductor in the center of said filter roll along said axis.

26. The method according to claim 17 comprising conducting electrical current through a first of said spiral wound conductors and then through a second of said spiral wound conductors in series, said first and second spiral wound conductors being axially adjacent.

27. The method according to claim 17 comprising shorting a first and a second of said spiral wound conductors to each other in series to provide a first conductor pair, shorting a third and a fourth of said spiral wound conductors to each other in series to provide a second conductor pair, and so on, to provide a plurality of conductor pairs.

28. The method according to claim 27 comprising selectively energizing and conducting electrical current through said plurality of conductor pairs.

29. The method according to claim 28 comprising conducting electrical current concurrently and in parallel through said conductor pairs.

30. The method according to claim 28 comprising conducting electrical current sequentially through said conductor pairs.

31. The method according to claim 16 comprising alternately sealing said wall segments to each other by a first upstream set of plugs to define a first set of flow channels closed by said plugs, and a second set of flow channels interdigitated with said first set of flow channels and having open upstream ends, and alternately sealing said wall segments to each other by a second downstream set of plugs closing said second set of flow channels, said first set of flow channels having open downstream ends.

* * * * *